US006758530B2

(12) United States Patent
Sollami

(10) Patent No.: US 6,758,530 B2
(45) Date of Patent: Jul. 6, 2004

(54) HARDENED TIP FOR CUTTING TOOLS

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 10/244,943

(22) Filed: Sep. 17, 2002

(65) Prior Publication Data

US 2003/0052530 A1 Mar. 20, 2003

Related U.S. Application Data

(60) Provisional application No. 60/323,164, filed on Sep. 18, 2001.

(51) Int. Cl.[7] ..... E21C 35/183

(52) U.S. Cl. ..... 299/111; 299/104; 299/105; 299/113

(58) Field of Search ..... 299/104, 105, 299/111, 112, 113

(56) References Cited

U.S. PATENT DOCUMENTS

| | | | | | |
|---|---|---|---|---|---|
| 4,603,911 | A | | 8/1986 | Hindmarsh | |
| 4,647,111 | A | * | 3/1987 | Bronder et al. | 299/113 |
| 4,660,890 | A | | 4/1987 | Mills | |
| 4,725,098 | A | | 2/1988 | Beach | |
| 4,821,819 | A | * | 4/1989 | Whysong | 299/113 |
| 5,417,475 | A | * | 5/1995 | Graham et al. | 299/105 |
| 5,823,632 | A | * | 10/1998 | Burkett | 299/104 |
| 6,196,636 | B1 | | 3/2001 | Mills | |
| 6,592,304 | B1 | * | 7/2003 | Kammerer | 407/119 |

FOREIGN PATENT DOCUMENTS

| | | | | |
|---|---|---|---|---|
| DE | 19924683 A1 | * | 11/2000 | E21C/35/183 |
| SU | 911024 | * | 3/1982 | |

* cited by examiner

*Primary Examiner*—John Kreck
(74) *Attorney, Agent, or Firm*—Robert L. Marsh

(57) ABSTRACT

A cutting tool has a tool body with a seat at the forward end thereof and a cutting insert in the seat. The insert has a central portion made of a hardened material, and surrounding the central portion is a softer metal sleeve. Surrounding the metal sleeve is a collar made of the hardened material.

19 Claims, 3 Drawing Sheets

HARDENED TIP FOR CUTTING TOOLS

The applicant claims priority from his previously filed and copending provisional application filed Sep. 18, 2001 and assigned serial No. 60/323,164. The present application relates to the cutting tips at the forward end of tools used to break up hard surfaces such as concrete and asphalt and, in particular, to an improved multi-element cutting insert at the forward end of such tools that offers, among other benefits, more protection to the tool body against wash away.

BACKGROUND OF THE INVENTION

Machines used to break up concrete and asphalt pavement and other hard surfaces have a plurality of tools mounted on a cutting wheel which is forced against the surface to be broken up. Each tool has an elongate steel body at the forward end of which is a tungsten carbide cutting tip. Until the present invention the cutting inserts of such tools have been formed as a unified part. When the wheel rotates, the tools are carried through a circular orbit and the tungsten carbide tips penetrate the hard surface with each tip removing a small amount of material, thereby advancing the cut.

The tools suffer wear as a result of being moved against the hard material being cut and they have to be replaced at regular intervals. Each time the tools are replaced, the machine is taken out of service for a lengthy period of time. Machines used to break up concrete and asphalt roadways are kept in continuous operation through the work day except for when the tools are being replaced, and it is not uncommon to replace the tools in such machines two or three times during a work day. The frequency with which tools have to be replaced and the time consumed during the replacement process therefore reduce the efficiency of the machine and increase the cost of its operation.

The cost of replacement tools and the efficiency with which the tools cut the hard abrasive material also effect the economic efficiency of the machine. To minimize tool costs it desirable that the components of the tool, namely the tool body and the tungsten carbide cutting tip, have comparable endurance to wear. The energy needed to operate the machines, and therefor the cost of operation, increases if the cutting tips become too blunt before the tool body has become sufficiently worn to require replacement. Both the cost of the tool and the cutting efficiency of the tool are important factors in maximizing the efficiency of the tools.

Tool failure can occur as a result of the failure the braze material holding the tungsten carbide tip into the seat at the forward end of the tool body. To prevent failure of the braze and the dislodging of the insert, the hardened inserts of such tools should have a base diameter of about 0.700 inches.

Theoretically, the life of the cutting insert will be increased by providing a larger sized insert, however enlarging the diameter of a currently available one piece tungsten carbide cutting tip will reduce the efficiency of the machine because the tip will rapidly become blunt. Since the tungsten carbide is the most expensive element in the tool, increasing the size of the insert will also increase tool cost. On the other hand, the metal which makes up the tool bodies is subject to wash away causing the tool to fail as aggregate of the hard material cut by the machine erode away the metal of the tool body behind the tungsten carbide tip.

It has long been recognized that the useful life of a tool can be substantially extended by increasing the hardness of the tungsten carbide from which the cutting inserts are made. Efforts to make a tool having a harder insert, however, have not been successful party because harder grades of tungsten carbide are more brittle and tend to fracture, and partly because the harder grades of tungsten carbide are more difficult to manufacture. A harder insert is manufactured by using smaller grain sizes of tungsten carbide particles with a higher concentration of tungsten carbide and a corresponding lower concentration of cobalt. It is the cobalt which cements the sintered tungsten carbide together and to compensate for the reduction of cobalt in the product the particles must also be more uniformly compacted together prior to sintering to reduce the inter granular porosity. If the particles are not uniformly compacted the completed insert will have less dense areas, or porosity, and be subject to failure. Inserts having contoured profiles, such as the insert shown in Ojanen, U.S. Pat. No. 4,497,520, are compacted in dies having contoured walls that are inadequate for uniformly compacting the smaller sized particles needed for a harder insert.

One effort to provide an insert which is made of a harder grade of tungsten carbide which is not subject to fracture is depicted in FIGS. 15-17 of U.S. Pat. No. 5,551,760 to Sollami. The insert depicted in Sollami has a cylindrical core and surrounding the core is an annular collar made of a softer grade of tungsten carbide. The core and the collar are bonded together with a braze joint. The Sollami tip has not reach its expectations because the braze material which holds the parts together does not bond readily to tungsten carbide but does bond well to cobalt, which comprises only a small percentage of the composite material. The problem is exacerbated for the harder grades of tungsten carbide because the cobalt content is a factor in the hardness of the tungsten carbide; hardness being increased as the percentage of cobalt is reduced.

The useful life of the tools could be greatly increased by the provision of a cutting tip as shown by Sollami provided the brazing problems encountered by Sollami could be overcome.

BRIEF DESCRIPTION OF THE INVENTION

Briefly, the present invention is embodied in a cutting tool for a cutting machine where the tool has a body with a longitudinal axis, a tapered cutting portion symmetric about the axis, a radial flange axially behind the forward cutting portion and a cylindrical shank axially behind the radial flange. The tool body has a seat at the forward end of the cutting portion, and the seat has a generally cylindrical inner wall with a given diameter into which a tungsten carbide insert is brazed.

In accordance with the invention, the hardened insert is made of three components assembled in coaxially relationship. The central portion of the insert is an elongate cylindrical body at the forward end of which is a tapered cutting end. Fitted around the cylindrical body is a non-carbide metal sleeve and fitted around the circumference of the non-carbide metal sleeve is an annual collar made of tungsten carbide. The outer diameter of the collar is sized to fit within the given diameter of the seat at the forward end of the tool body. A braze material retains the sleeve to the central body, retains the collar to the sleeve and retains the assembled insert within the seat at the forward end of the cutting tool.

It has been found that the provision of the metal sleeve between the cylindrical central portion and the annular collar provides a surface which is receptive to liquefied braze material and will draw liquefied braze material between the parts by capillary action so they can bond to the tungsten carbide and retain the parts of the insert in assembled relationship. Another function of the metal sleeve is to more rapidly conduct heat to the assembled parts during brazing. The metal sleeve also offers significant shock absorbing qualities which protects the cylindrical central body of tungsten carbide from fracturing because steel has 15% to 20% elongation properties even when hardened to Rc 43-46.

In a second embodiment of the invention the metal sleeve is machined into the forward end of the tool body. In this embodiment the seat at the forward end of the tool body has two components, a cylindrical central indentation with a conical floor, and surrounding the cylindrical central indentation is an annular indentation. The cylindrical central indentation and the annular indentation are machined into the forward end of the tool body leaving a tubular protrusion standing between them. The cylindrical body of the insert described with respect to the first embodiment and the annular collar of the first embodiment are simultaneously brazed into their respective annular indentation.

BRIEF DESCRIPTION OF THE DRAWINGS

A better and more complete understanding of the invention can be had after a reading of the following detailed description taken in junction with the drawings wherein.

DETAILED DESCRIPTION OF THE PREFERRED EMBODIMENT

Figure 1:
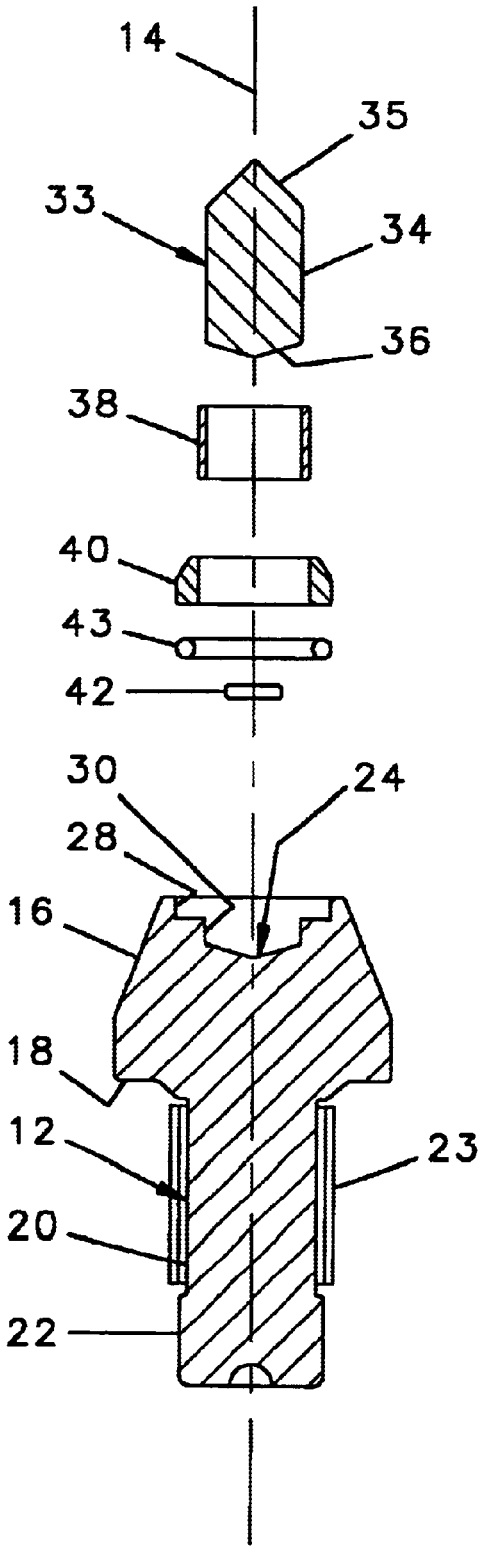
FIG. 1 is an exploded cross sectional view of a tool consisting of a tool body and an insert in accordance with the present invention.
Figure 2:
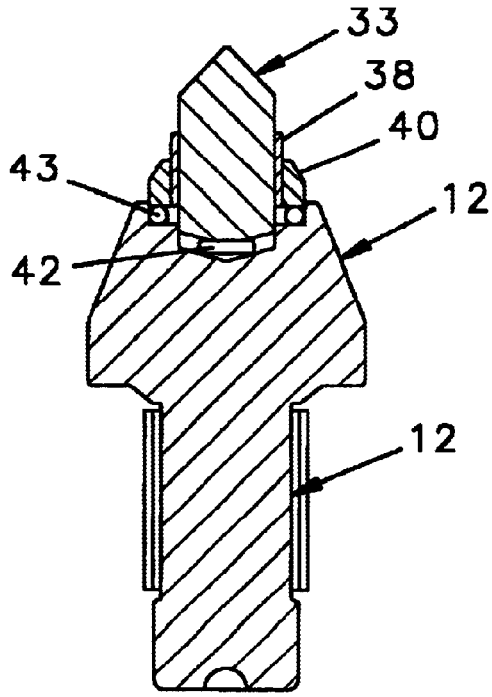
FIG. 2 is a cross sectional view of the tool and insert shown in FIG. 1 with the components of the insert assembled to the tool body prior to the melting of the braze material.
Figure 3:
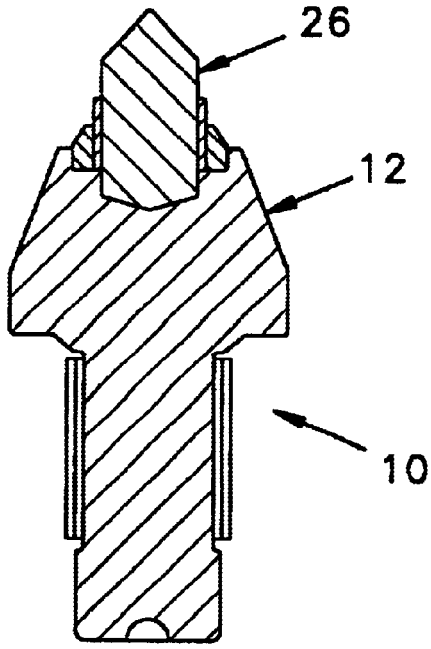
FIG. 3 is a cross sectional view of the tool shown in FIG. 1 in assembled relationship.

Referring to FIGS. 1, 2 and 3, a tool 10 has an elongated body 12 symmetrical about its longitudinal axis 14. The tool includes a tapered forward section 16, at the rearward end of which is a radial flange 18. Extending axially rearward of the flange 18 is a cylindrical shank 20 at the distal end of which is a cylindrical hub 22. Retained around the shank 20 and the hub 22 is an expandable sleeve 23 for retaining the tool 10 in the bore of a tool holder on a machine, not shown. At the forward end of the forward section 16 is a seat 24 into which is brazed a cutting insert 26.

In accordance with the invention, the seat 24 has a large diameter cylindrical bore 28 and centered at the bottom of which is a smaller diameter cylindrical bore 30. Between the large diameter bore 28 and the smaller diameter bore 30 is a generally planar annular shoulder 31. The floor 32 of the smaller diameter cylindrical bore 30 is conical and forms an inner seat for the central portion of the insert as is further described below.

Sized to fit within the smaller diameter bore 30 of the seat 24 is a cylindrical tungsten carbide core 33 having a cylindrical central portion 34, a conical forward cutting end 35 and a conical rear surface 36 complimentary in shape to the conical floor 32 of the seat 24. Fitting around the cylindrical core 33 is a tubular sleeve 38 having an inner diameter which is a little larger than the outer diameter of the cylindrical central portion 34 such that braze material can be drawn up between the surfaces of the central portion 34 and the sleeve 38 by capillary action. The tubular sleeve 38 is preferably made of a magnetically susceptible metal such as steel which will also attract liquefied braze material.

Fitted around the outer circumference of the tubular sleeve 38 is an annular collar 40 made of tungsten carbide. The annular collar 40 has an inner diameter sized a little larger than the outer diameter of the tubular sleeve 38 such that a braze material may be drawn up between the inner surface of the annular collar 40 and the outer surface of the tubular sleeve 38 by capillary action. The outer diameter of the annular collar 40 is a little less than the inner diameter of the large diameter cylindrical bore 28 of the seat 24, thereby allowing space for the braze material between the outer surface of the collar 40 and the cylindrical inner surface 28. Bumps, not shown, may be provided on the outer surfaces of the cylindrical core 33 and the collar 40 to space the surface of the tungsten carbide from that of the steel surfaces of the bores 28, 30 and the sleeve 38 sufficient for receiving liquefied braze material.

During the manufacturing process, a wafer of braze material 42, having an outer diameter less than the smaller diameter bore 30 is inserted into the bore 30 and a ring 43 of braze material having an outer diameter less than the large diameter bore 28 and an inner diameter larger than the outer diameter of the sleeve 38, is inserted on the shoulder 31. The parts are assembled together as shown in FIG. 2 with the shank 20 of the tool 10 extending downwardly as shown. As the parts are heated and the braze material 42 and 43 melts the parts are vibrated to encourage the force of gravity to seat the parts, including the core 33, the sleeve 38, and the collar 40, downwardly until they fall into assembled relationship within the inner and outer portions of the seat 24 and seat as shown in FIG. 3. As the parts become seated they displace liquid braze material which is then force upward between the parts. The receptive qualities of the steel sleeve 38 will also draw the liquefied braze material 42, 43 between the surfaces of the sleeve 38 and the adjacent cylindrical core 34 and collar 40. After the parts are allowed to cool, the parts will be firmly retained in assembled relationship by the braze which will be spread evenly between the parts.

In the preferred embodiment, the central core 33 is made of a grade of tungsten carbide having a hardness of from Ra 88.5 to Ra 90.0 and the annular collar 40 is made of tungsten carbide having a hardness of Ra 85 to Ra 88. The collar 40 and the sleeve 38 will provide shock absorbing qualities so as to prevent the fracturing of the insert and will protect the metal of the tool body from erosion by hard particles loosened by the tool.

Figure 4:
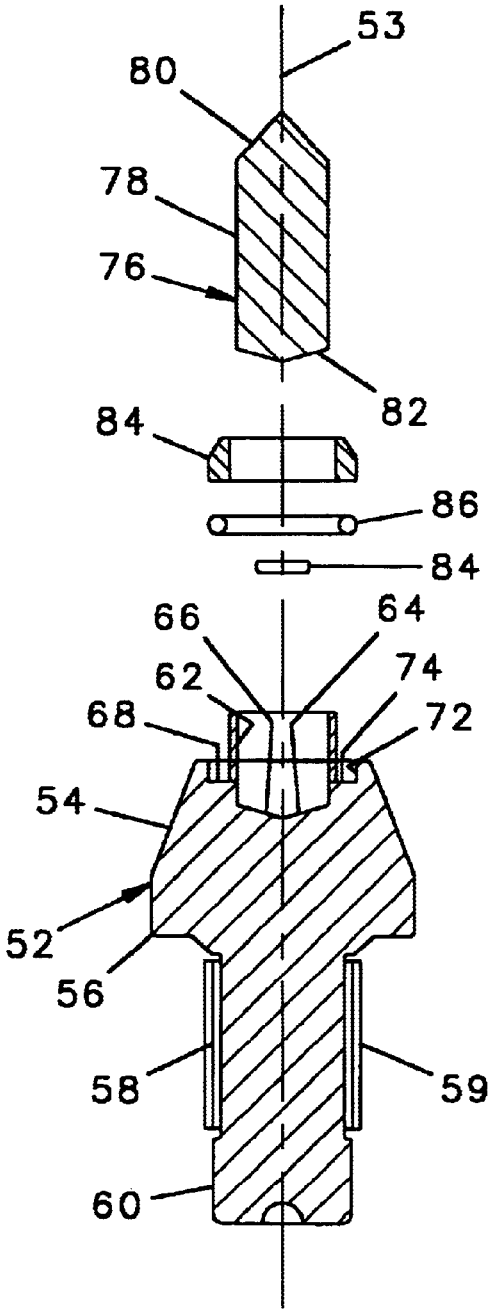
FIG. 4 is an exploded view of an alternate embodiment of a tool and insert in accordance with the invention.
Figure 5:
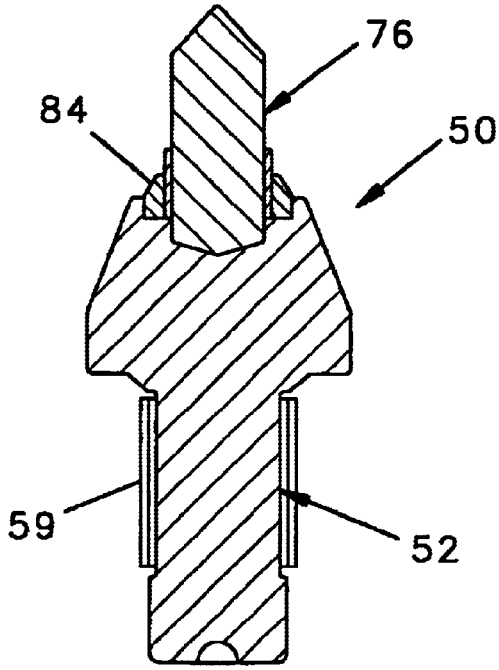
FIG. 5 is a cross sectional view of the assembled tool shown in FIG. 4.

Referring to FIGS. 4 and 5, a second embodiment of a tool 50 has a metal body 52 with an axis 53, a tapered forward portion 54, a radial flange 56, a cylindrical shank 58, a retainer sleeve 59 and a hub 60 similar to the parts described with respect to the first embodiment of the tool 10. At the forward end of the tool 50 is a centrally located first seat 64 having a cylindrical inner wall 62 and a conical bottom 66. Radially outwardly of the first seat 64 is an annular second seat 68 having a cylindrical inner wall 70, a cylindrical outer wall 72 and a generally planar bottom 74.

Fitted within the centrally located first seat 64 is a tungsten carbide core 76 having a cylindrical central portion 78 at the forward end of which is a conical cutting tip 80 and at the rearward end of which is a conical base 82 complimentary in shape to the conical bottom 66 of the seat 64. A wafer of braze material 84 is fitted between the core 76 and the bottom 66 of the seat 64.

Fitted into the annular second seat 68 is an annular collar 84. The collar 84 has an inner diameter sized a little larger than the outer diameter of the inner wall 70 of the seat 68 and an outer diameter which is a little less than the cylindrical outer wall 72 of the seat 68. An annular ring of braze material 86 is fitted between the bottom 74 of the second seat 68 and the collar 84. The parts are assembled with the shank 58 of the tool body 52 extending downwardly and are subjected to heat to melt the braze material 84, 86. As the braze material 84, 86 melts the parts are vibrated until the tungsten carbide core 76 and the collar 84 move downwardly into their respective seats 64, 68. The tungsten carbide parts will displace liquefied braze causing it to move between the cylindrical inner wall 62 and the cylindrical portion 78 of the core and between the cylindrical walls 70 and 72 and the tungsten carbide surfaces of the collar 84. The receptive qualities of its steel surfaces 70, 72 will also attract the liquefied braze material such that it is spread evenly between the parts. As the parts cool, the braze will form a strong bond which extend across the entire contact surfaces of the core 76 and the collar 84.

As with the tool 10, the core 76 of the tool 50 is preferably made of a harder grade of tungsten carbide than the collar 84. The tool 50 will, therefore, have an extended useful life because the cutting end thereof will remain sharp for a longer period of time and will not be dislodged because of weakness of the braze or to fracture of the tungsten carbide. The tungsten carbide collars 40, 84 will protect the metal of the forward section 16, 54 of the respective tools bodies 12, 52 and thereby extend the useful life of the tools 10, 50.

Figure 6:
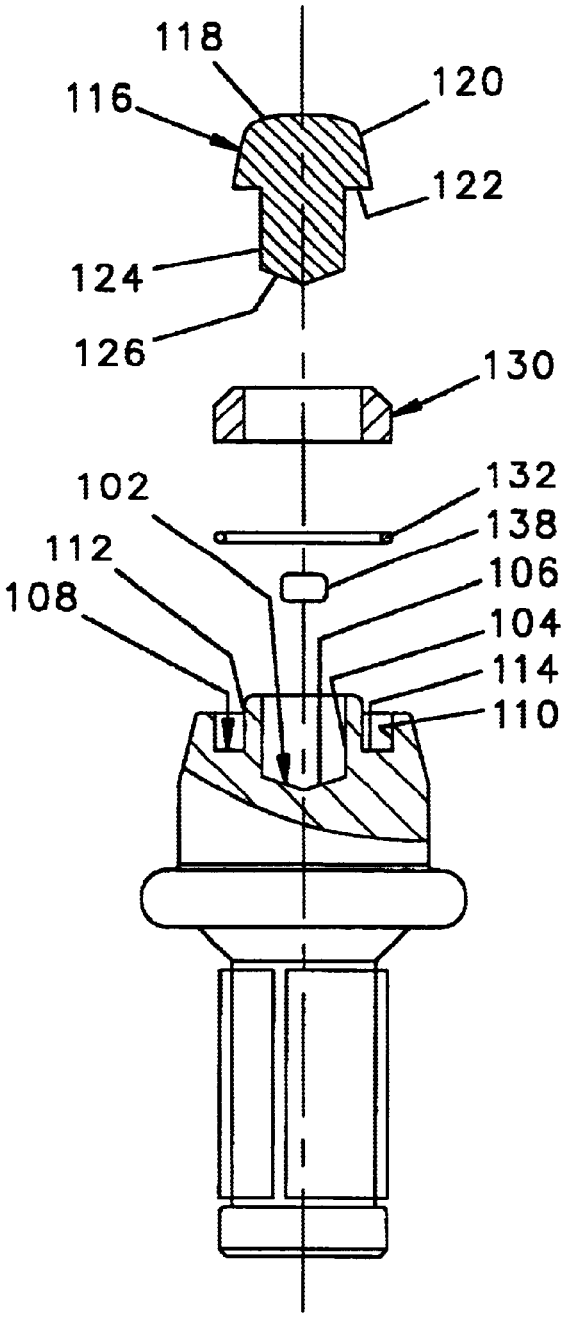
FIG. 6 is an exploded side elevational view, partly in cross section, of a third tool embodying the invention.
Figure 7:
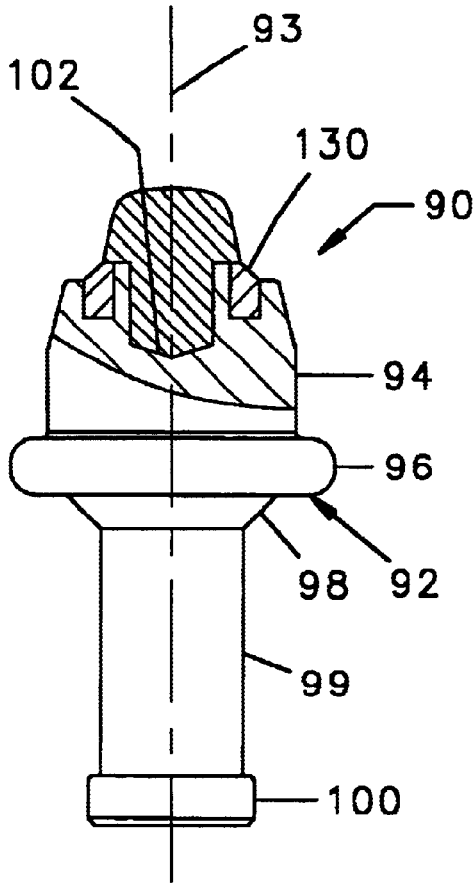
FIG. 7 is and assembled side elevational view, partially in cross section, of the tool shown in FIG. 6.

In FIGS. 6 and 7 a modification of the second embodiment 50 of the invention is depicted. In this embodiment a tool 90 has a metal body 92 with an axis 93, a tapered forward portion 94, a radial flange 96, a cylindrical shank 98, a retainer sleeve 99 and a hub 100. At the forward end of the tool 90 is a centrally located first seat portion 102 having a tapered inner wall 104 and a conical bottom 106. Radially outwardly of the first seat 102 is an annular second seat portion 108 having a cylindrical inner wall 110, a cylindrical outer wall 112 and a generally planar bottom 114, all of which is similar to the tool body of the second embodiment 50.

Fitted within the central first seat 102 is a tungsten carbide core 116 having a blunt forward end 118 behind which is a frustoconical midsection 120. Behind the frustoconical midsection 120 is an inwardly directed planar shoulder 122, and axially behind the shoulder 122 is a rearwardly extending frustoconical base 124 having a conical rearward surface 126. The base 124, including the rear surface 126 is sized a little smaller than the dimensions of the seat 102 so as to allow liquid braze to flow between the parts Fitted into the second seat 108 is an annular collar 130 similar to the collar 84 of the tool 50. The collar 130 has an inner diameter sized a little larger than the outer diameter of the inner wall 110 of the second seat portion 108 and an outer diameter which is a little less than the cylindrical outer wall 112 of the second seat portion 108. A ring of braze material 132 is fitted into the second seat 108 prior to inserting the annular collar 130 therein.

In this embodiment the outer diameter of the shoulder 122 of the core 116 is equal to or greater than the diameter of the cylindrical inner wall 110 of the second seat portion 108 and therefor the annular collar 130 must be inserted into the second seat 108 before the core 116 is inserted into the central seat 102. A wafer of braze material 138 is fitted between the rear surface 126 of the core 116 and the bottom 106 of the seat 102 after which the parts are heated to melt the braze material 132, 138. As the braze melts gravity causes the parts to seat. After the parts are allowed to cool the tool 90 is in the assembled form shown in FIG. 7.

As best shown in FIG. 7 the maximum diameter of the frustoconical midsection 120, which occurs at the juncture with the shoulder 122 is greater than the diameter of the cylindrical inner wall 110 of the second seat portion 108. The core 116, therefor, assists in the seating of the annular collar 130 because the weight of the core 116 draws both the core 116 and the collar 130 to the bottoms of their respective seats 102, 108.

Except for the assistance contributed by the weight of the core body 116 the parts are assembled as described with respect to the parts of the tool 50 described above. As with the other embodiments the core body 116 of the tool 90 is preferably made of a harder grade of tungsten carbide than the collar 130.

An advantage of this embodiment is that the core 116 will protect the tubular sleeve of steel standing between the first sear portion 102 and the second seat portion 108. The cutting tip formed by the core body 116 and the collar 130 will provide some of the same cutting qualities of the tip disclosed in Ojanen U.S. Pat. No. 4,497,520.

There has, therefore, been disclosed an improved cutting tool having a tip which will be more resistive to wear and will not become dull so as to decrease the efficiency of the machine to which is attached.

It will be appreciated that there are many modifications and variations which fall within the true spirit and scope of the invention. It is therefor the intent of the following claims to cover all such modifications and variations which fall within the true spirit and scope of the invention.

What is claimed:

1. A cutting tool comprising a tool body having a longitudinal axis, a tapered cutting portion symmetrical about said axis and a cylindrical shank axially behind said tapered cutting portion, said tool body having a seat at a forward end of said cutting portion, said seat having a given outer diameter, an insert bonded into said seat, said insert comprising a central portion made of a hardened material and having a tapered forward cutting end and an elongate mid-section positioned axially behind said tapered cutting end, a tubular metal sleeve fitted around at least a portion of said elongate mid-section of said central portion, and an annular collar made of said hardened material, said annular collar having an aperture into which at least a portion of said metal sleeve is fitted, and an outer diameter sized to fit within said given outer diameter of said seat.

2. A cutting tool in accordance with claim 1 wherein said hardened material is tungsten carbide.

3. A cutting tool in accordance with claim 2 wherein said central portion is made of a harder grade of tungsten carbide than said annular collar.

4. A cutting tool in accordance with claim 1 wherein said elongate mid-section has a cylindrical cross section and said tubular metal sleeve is cylindrical.

5. A cutting tool in accordance with claim 1 wherein said parts are bonded together with a braze material.

6. A cutting tool comprising a tool body having a longitudinal axis, a tapered cutting portion symmetrical about said axis and a cylindrical shank axially behind said tapered cutting portion, said tool body having a seat at a forward end of said cutting portion, said seat having an inner seat portion and an annular outer seat portion, said inner seat portion including a first outer wall and a bottom surface, said annular outer seat portion including a second outer wall and an annular shoulder, said second outer wall having a diameter larger than said first outer wall, an insert bonded into said seat, said insert comprising a central portion made of a hardened material and having a tapered forward cutting end and an elongate mid-section positioned axially behind said tapered forward cutting end, a tubular metal sleeve fitted around at least a portion of said elongate mid-section of said central portion, and an annular collar made of said hardened material, said annular collar having an aperture into which at least a portion of said metal sleeve is fitted, and an outer diameter sized to fit within said second outer diameter of said outer seat portion.

7. A cutting tool in accordance with claim 6 wherein a rearward end of said central portion is sized to fit within said outer wall of said inner seat portion.

8. A cutting tool in accordance with claim 6 wherein said hardened material is tungsten carbide.

9. A cutting tool in accordance with claim 8 wherein said central portion is made of a harder grade of tungsten carbide than said annular collar.

10. A cutting tool in accordance with claim 6 wherein said elongate mid-section has a cylindrical cross section and said tubular metal sleeve is cylindrical.

11. A cutting tool in accordance with claim 6 wherein said parts are bonded together with a braze material.

12. A cutting tool comprising a tool body having a longitudinal axis, a tapered cutting portion symmetrical about said axis and a cylindrical shank axially behind said tapered cutting portion, said tool body having an inner seat at a forward end of said cutting portion, said tool body further having an annular outer seat surrounding said inner seat wherein a cylindrical wall separates said inner seat from said outer seat, said inner seat including an outer wall and bottom surface, a first insert bonded in said inner seat, said first insert having a forward cutting end and a base, said base sized to fit within said inner seat, said annular outer seat including an outer wall, an inner wall and an annular floor extending between said inner wall and said outer wall, said forward end of said first insert having a maximum outer diameter at least equal to a diameter of said inner wall of said out seat, and an annular insert bonded into said annular outer seat.

13. A cutting tool in accordance with claim 12 wherein said first insert and said annular insert are made of tungsten carbide.

14. A cutting tool in accordance with claim 13 wherein said first insert is made of a harder grade of tungsten carbide than said annular insert.

15. A cutting tool in accordance with claim 12 wherein said first insert and said annular insert are bonded to said inner seat and said annular outer seat with a braze material.

16. A cutting tool in accordance with claim 12 wherein said annular insert in said outer seat is an annular collar made of tungsten carbide, said annular collar having a cylindrical bore sized to fit around said inner wall, and an outer diameter sized to fit within said outer wall of said outer seat.

17. A cutting tool in accordance with claim 12 wherein said base is tapered.

18. A cutting tool in accordance with claim 12 where said forward cutting end has a maximum diameter larger than a maximum diameter of said base.

19. A cutting tool comprising a tool body having a longitudinal axis, a tapered cutting portion symmetrical about said axis and a cylindrical shank axially behind said tapered cutting portion, said tool body having an inner seat at a forward end of said cutting portion, said tool body further having an annular outer seat surrounding said inner seat wherein a cylindrical wall separates said inner seat from said outer seat, said inner seat including an outer wall and bottom surface, a first insert bonded in said inner seat, said first insert having a forward cutting end and a tapered base, said base of said first insert sized to fit within said inner seat, said forward cutting end of said first insert having a maximum diameter larger than a maximum diameter of said base, said annular outer seat including an outer wall, an inner wall and an annular floor extending between said inner wall and said outer wall, said forward end of said first insert having a maximum outer diameter at least equal to a diameter of said inner wall of said outer seat, and an annular insert bonded into said annular outer seat.

* * * * *